United States Patent [19]

Lane et al.

[11] Patent Number: 5,050,398

[45] Date of Patent: Sep. 24, 1991

[54] ICE MAKING MACHINE WITH REMOTE VENT

[75] Inventors: Robert C. Lane, Rockford, Ill.; Joseph M. Lee, Houston, Tex.

[73] Assignee: Specialty Equipment Companies, Inc., Rockton, Ill.

[21] Appl. No.: 577,198

[22] Filed: Sep. 4, 1990

[51] Int. Cl.[5] ..... F25B 39/04

[52] U.S. Cl. ..... 62/183; 62/428; 62/507

[58] Field of Search ..... 62/183, 184, 507, 428, 62/429

[56] References Cited

U.S. PATENT DOCUMENTS

| | | | |
|---|---|---|---|
| 2,167,380 | 7/1939 | Whitlock | 62/429 |
| 2,362,729 | 11/1944 | Smith | 62/428 X |
| 2,655,795 | 10/1953 | Dyer | 62/507 X |
| 2,892,324 | 6/1959 | Quick | 62/183 X |
| 3,208,236 | 9/1965 | Frigerio | 62/428 X |
| 3,263,438 | 8/1966 | Maudlin | 62/183 |
| 3,357,199 | 12/1967 | Harnish | 62/183 X |
| 4,694,656 | 9/1987 | Lane et al. | 62/347 X |
| 4,870,832 | 10/1989 | Crawley | 62/507 X |

*Primary Examiner*—William E. Tapolcai

*Attorney, Agent, or Firm*—Vernon J. Pillote

[57] ABSTRACT

A self-contained ice making machine including a cabinet divided into first and second separate compartments with an ice making head including an evaporator disposed in the first compartment and with a compressor and air cooled condenser disposed in a second compartment. Air from the room surrounding the ice machine is drawn through an air intake in a side of the cabinet and through the condenser into the second compartment by a condenser cooling fan, and a vent pipe having an exhaust fan is connected to an air discharge opening in the top of the second compartment for venting the second compartment outside of the room in which the ice making machine is installed.

9 Claims, 2 Drawing Sheets

ICE MAKING MACHINE WITH REMOTE VENT

BACKGROUND OF THE INVENTION

Ice making machines release large amounts of heat at the condenser of the refrigeration system during freezing of water into ice. Prior self-contained ice making machines were arranged to withdraw air for cooling the condenser from the room in which the ice making machine is installed and to discharge the condenser cooling air back into that room. This can cause the air temperature in the room in which the ice making machine is installed to progressively build up to relatively high temperatures and, as the temperature of the air for cooling the condenser increases, the refrigeration discharge pressure increases and reduces the ice making capacity and many self-contained ice making machines either stop producing ice at all or make an unsatisfactory ice product when the room temperature rises above 110° F.

In order to avoid the above problems, it is common practice, particularly in larger size ice making machines, to locate the condenser remote from the ice making machine, such as on the roof of the building. However, the remote condenser type installations are costly to make and install and are generally considered economically impractical for ice machines having a rated capacity of 800 pounds per day or less.

SUMMARY OF THE INVENTION

It is an object of the present invention to overcome the problems of prior art ice making machines by providing a self-contained ice making machine having an improved arrangement for venting the condenser cooling air, and which is simple and economical to manufacture and install.

Accordingly, the present invention provides a self-contained ice making machine including a cabinet having partition means dividing the cabinet into first and second separate compartments. An ice making means including an evaporator means is disposed in the first compartment, and compressor means and air cooled condenser means are disposed in the second compartment and connected in a refrigeration system with the evaporator means in the first compartment. The cabinet has air inlet means in one of the side wall for communicating the second compartment with a room in which the ice making machine is installed, and condenser cooling fan means is provided in the second compartment for drawing air through the air inlet means and through the condenser means into the second compartment. An air discharge opening is provided in the top wall of the cabinet communicating with the second compartment and a vent pipe means is connected to the air discharge opening for venting the second compartment outside side of the room in which the ice making machine is installed, an, exhaust fan means are provided in the vent pipe means for exhausting air from the second compartment through the vent pipe means.

In many buildings in which self-contained ice machines are installed, the space above the ceiling is vented either through a louvered vent or fan vent to the atmosphere outside the building.

The vent pipe means is preferably arranged to extend outwardly from the top of the cabinet and through the ceiling into the vented space above the ceiling. With this arrangement, updraft of the heated air by convection aids the exhaust fan in exhausting the air from the condenser compartment in the cabinet. Alternatively, the vent pipe means can be arranged to vent directly to the outside of the building.

Ice making machines commonly employ a condenser cooling fan control which senses the temperature and/or pressure of the refrigerant discharged from the compressor and turns the condenser cooling fan on and off to control the compresser discharge pressure during the ice making and ice harvest cycles. However, it has been found advantageous to operate the exhaust fan continuously when the compressor is operating, and that this reduces the cycling of the condenser cooling fan and also reduces the overall time that the condenser cooling fan has to operate. It has also been found that the exhaust fan can be of relatively low wattage rating and air flow capacity as compared to the condenser cooling fan and yet reduce heat build-up in the room and cycling of the condenser cooling fan.

DETAILED DESCRIPTION

Figure 1:
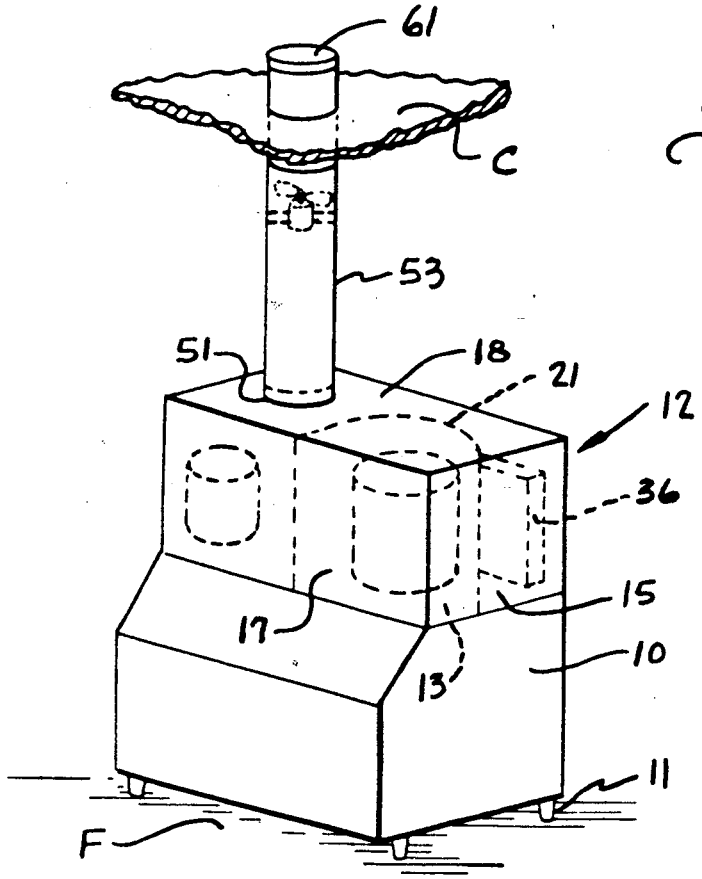
FIG. 1 is a schematic perspective view illustrating an ice making machine and vent system in accordance with the present invention.

The self-contained ice making machine in general includes an ice receiving bin 10 supported as by legs 11 on the floor of a room having walls W and a ceiling C. The ice making apparatus is inclosed in a cabinet 12 supported on top of the bin and extending upwardly therefrom. The cabinet includes a bottom 13, and side walls 14, 15, 16 and 17 extending upwardly from the bottom wall at the rear, opposed sides and front of the cabinet, and a top wall 18. The cabinet is divided by a partition means 21 into first and second separate compartments designated C1 and C2 in FIG. 2. The partition 21 is constructed and arranged in the cabinet so as to inhibit air flow between the compartments and, as shown, the partition 21 extends between the side walls 15 and 17 from the bottom 13 to the top wall 18 of the cabinet.

Figure 2:
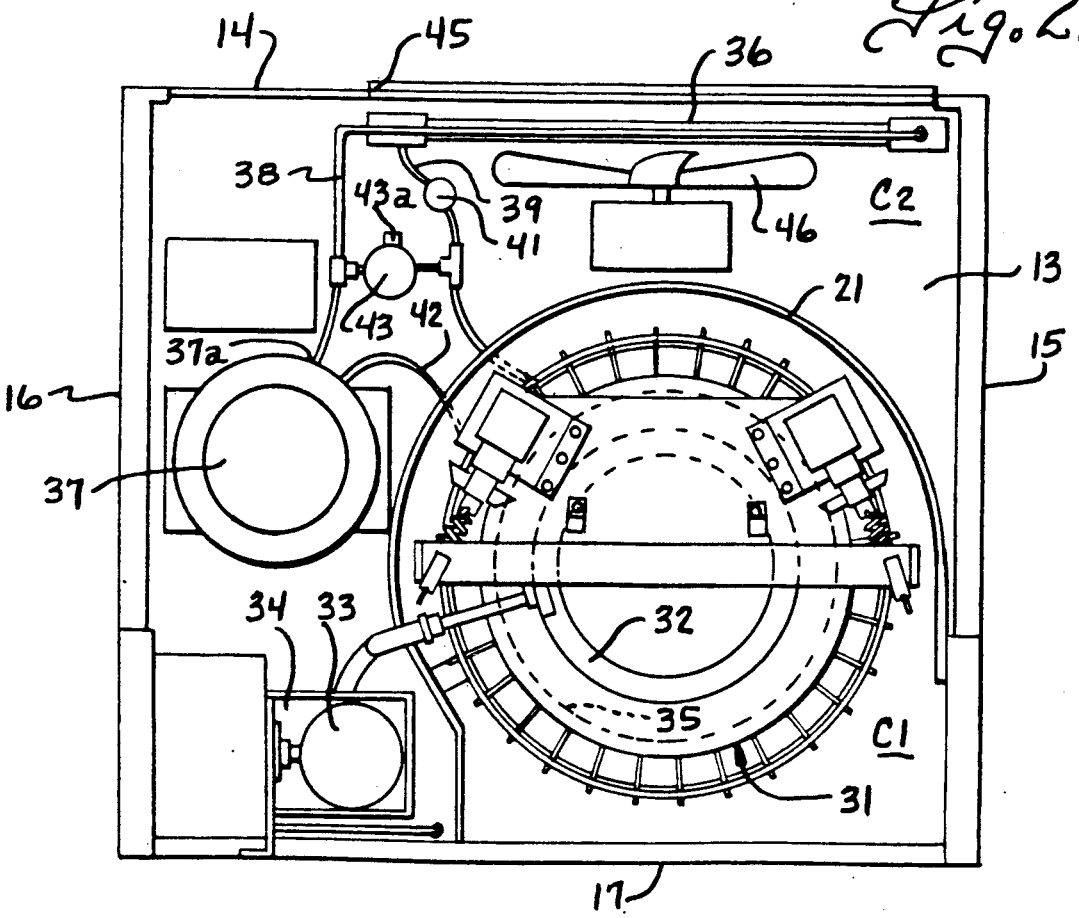
FIG. 2 is a top view of the self-contained ice making unit with the top wall removed.

Ice mold means 31 is mounted in the first compartment C1 and water supply means including spray bar 32 and pump 33 are provided for supplying water from the water reservoir to the ice mold means during a freezing cycle to freeze ice product on the ice mold means. The ice mold means can be of various different configurations and, in the embodiment illustrated, is of the type disclosed in U.S. Pat. No. 4,694,656 to which reference is made for a more complete description. The evaporator 35 of a refrigeration system (FIG. 2) is mounted in the first compartment C1 in heat exchange relation with the ice mold means, and an air cooled condenser 36 and a compressor 37 of the refrigeration system are mounted in the second compartment C2. As shown in FIG. 2, the discharge outlet 37*a* of the compressor 37 is connected through a discharge line 38 to the condenser 36 and the outlet of the condenser is connected through a line 39 and refrigerant expansion control 41 to the evaporator 35, and refrigerant from the evaporator is returned through line 42 to the compressor inlet 37*b*. The refrigerating system is operable in an ice freezing mode to circulate refrigerant from the compressor 37 through the condenser 36 and through the refrigerant expansion control 41 to the evaporator 35 and a normally closed bypass valve 43 is provided and operable to an open position during an ice harvest mode to bypass the condenser and refrigerant expansion control 41 and to circulate refrigerant from the compresser to the evaporator means to heat the ice mold.

Figure 3:
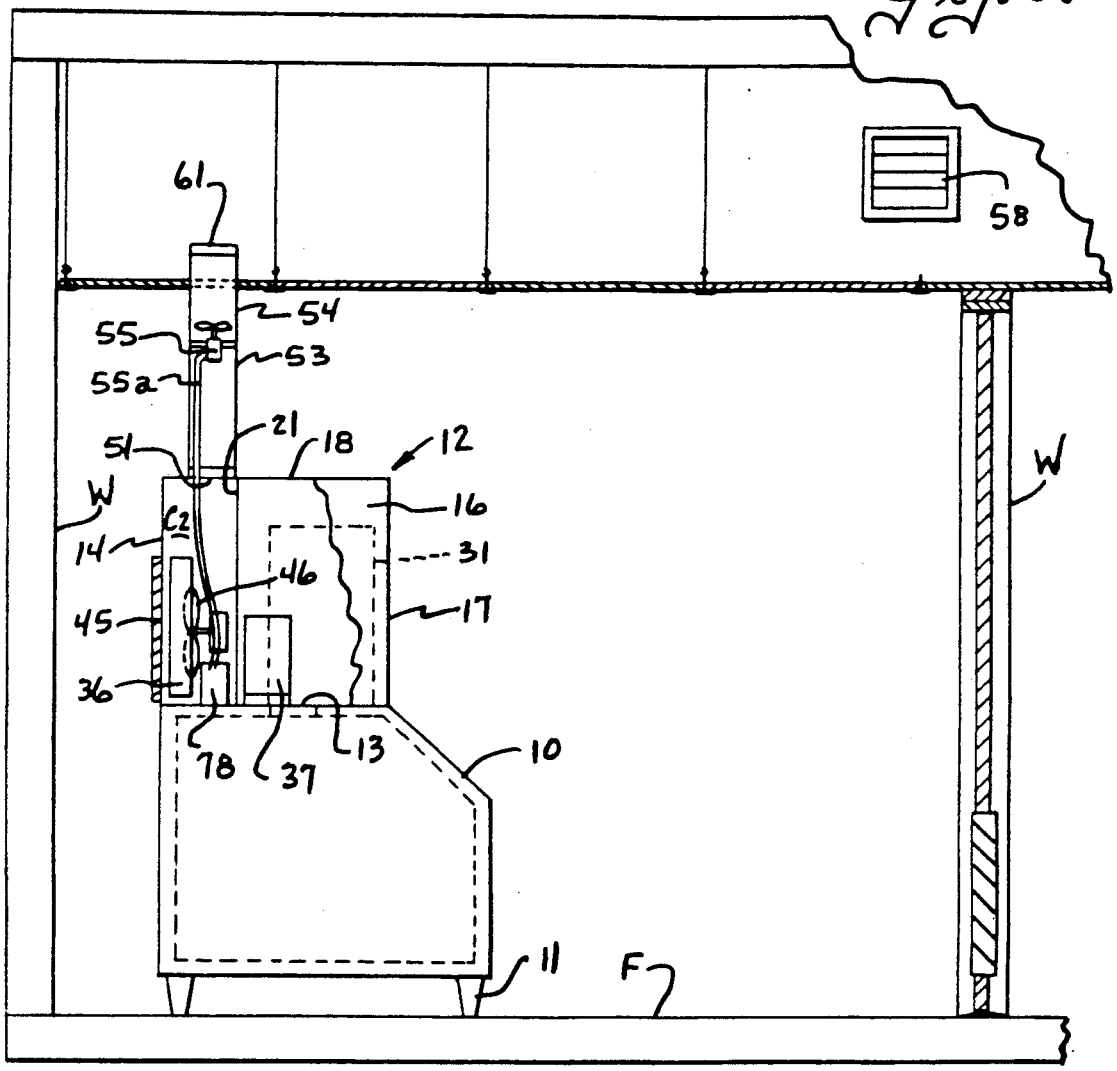
FIG. 3 is a schematic sectional view of an ice making machine and vent system installed in a building.

An air inlet opening 45 is provided in one of the side walls of the cabinet such as the rear wall 14 to communicate the second compartment with the room in which the ice making machine is installed, and the condenser 36 is mounted in the second compartment to extend across the air inlet opening as best shown in FIGS. 2 and 3. One or more condenser cooling fans 46 driven by a fan drive motor 47 are provided in the second compartment for drawing air through the air inlet opening 45 and through the condenser 36 and for discharging the air into the second compartment. An air discharge opening 51 is provided in the top wall 18 of the cabinet at a location to communicate with the second compartment C2, and a vent pipe 53 is connected to the air discharge opening for venting the second compartment outside the room in which the ice making machine is installed. An axial flow or propeller type exhaust fan 54 having a drive motor 55 is mounted in the vent pipe 53 for exhausting air from the second compartment through the vent pipe. In restaurants, hotels and the like, the space above the ceiling C is commonly vented to the outside of the building either through a powered vent or a louvered vent such as indicated at 58 in FIG. 3. In such installations, the vent pipe need only extend from the top of the cabinet through the ceiling C into the space above the ceiling. Alternatively, the vent pipe can be extended through an outside wall of the building to exhaust air outside of the building. A screen, or grid 61 is preferably provided on the outlet end of the vent pipe.

Figure 4:
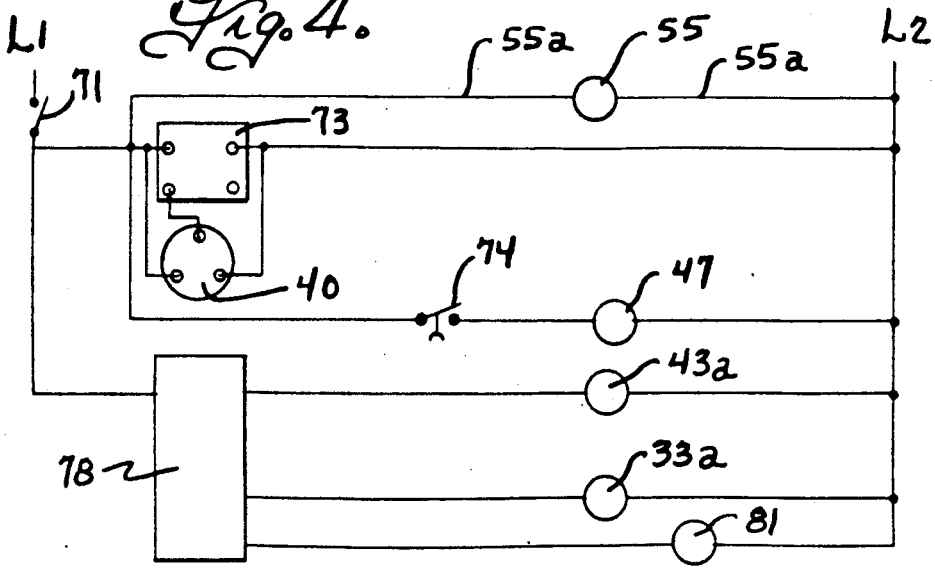
FIG. 4 is a schematic diagram illustrating the electrical controls for the ice machine.

Reference is now made more specifically to the schematic diagram in FIG. 4 of an electrical control circuit for the ice making machine. As shown, power is supplied through a switch such as a manual switch or a bin fill control switch 71 in line 61, and the switch 71 is operative when closed to establish a circuit to a motor start relay 73 to start a drive motor 40 for compressor 37. As is conventional, the condenser fan drive motor 47 is controlled by a condenser fan control switch 74 which is arranged to sense temperature and/or pressure of the refrigerant in the compressor discharge line and start and stop the condenser fan to control the compressor discharge pressure. An ice making cycle control 78 is provided to control operation of the electro-responsive operator 43*a* for the bypass valve 43; the drive motor 33*a* for the water circulation pump 33, and the electro-responsive operator 81 for a water drain valve (not shown) for draining of water from the reservoir 34. In general, the typical ice making cycle control operates the refrigeration apparatus and water circulation apparatus alternately in an ice freezing mode in which refrigerant from the compressor is circulated through the condenser and refrigerant expansion control to the evaporator while water is distributed over the ice mold to freeze an ice product on the ice mold, and an ice harvest mode in which the flow of water to the ice mold is shut off and the bypass valve is opened to circulate refrigerant from the compressor to the evaporator to heat the evaporator. The ice making cycle control may, for example be of the type disclosed in U.S. Pat. No. 4,884,413, assigned to the assignee of the present invention.

The condenser cooling fan is cycled on and off as the ice machine goes through an ice making cycle including the ice freezing mode and an ice harvest mode. It has been found advantageous, however, to operate the exhaust fan 54 continuously while the compressor is operating and, as shown in FIG. 4, the exhaust fan drive motor 55 is connected through conductors 55*a* so as to operate the exhaust fan whenever the compresser drive motor 40 is operated. When the exhaust fan is operated in continuous fashion, it reduces the cycling of the condenser fan off and on and further has been found to reduce the overall time that the condenser cooling fan operates. The conductors 55*a*, are conveniently routed as shown in FIG. 3 to extend downwardly through the vent pipe 53 into the second compartment C2 in the cabinet to the ice making cycle control.

From the foregoing it is thought that the construction and operation of the self-contained ice machine with remote vent will be readily understood. The condenser cooling fan draws air from the room in which the machine is installed to cool the condenser and the exhaust fan exhausts air from the top of the second compartment to an outlet outside of the room so that the hot condenser cooling air ia not discharged back into the room. The vent pipe and exhaust fan not only reduces heating of the room in which the ice machine is installed, but also improves the performance of the ice making machine when the temperature in the room rises.

The embodiments of the invention in which an exclusive property or privilege is claimed are defined as follows:

1. A self-contained ice making machine including a cabinet having a bottom, side walls extending upwardly from the bottom and a top wall, partition means dividing the cabinet into first and second separate compartments, ice making means including evaporator means in the first compartment, compressor means and air cooled condenser means in the second compartment and connected in a refrigeration system with the evaporator means in the first compartment, the cabinet having air inlet means in one of the side walls for communicating the second compartment with a room in which the ice making machine is installed, condenser cooling fan means in the second compartment for drawing air through the air inlet means and through the condenser means into the second compartment, the cabinet having an air discharge opening communicating with the second compartment, vent pipe means connected to the air discharge opening for venting the second compartment outside of a room in which the ice making machine is installed, exhaust fan means in the vent pipe means for exhausting air from the second compartment through the vent pipe means, and circuit means for controlling operation of said compressor means and said condenser means and said exhaust fan means, the circuit means including means for turning the condenser cooling fan means on and off to control compressor discharge pressure, and means for operating said exhaust fan means when the compressor means is operating.

2. An ice making machine according to claim 1 wherein air discharge opening is in the top wall and the vent pipe means extends upwardly from the cabinet means through a ceiling of a room in which the ice making machine is installed.

3. An ice making machine according to claim 1 wherein the circuit means includes electrical power conductors extending from the second compartment and inside the vent pipe means to the exhaust fan means.

4. An ice making machine according to claim 1 wherein said condenser cooling fan means is mounted for rotation about a generally horizontal axis.

5. A self-contained ice making machine comprising a cabinet having a bottom, side walls extending upwardly from the bottom and a top wall, partition means dividing the cabinet into first and second separate compartments, ice mold means in the first compartment and means for controlling flow of water to the ice mold means, a refrigeration system including evaporator means in the first compartment and compressor means and air cooled condenser means in the second compartment, the refrigeration system including means operable in an ice freezing mode for circulating refrigerant from the compressor means through the condenser means and through a refrigerant expansion control to the evaporator means to refrigerate the ice mold means and operable in an ice harvest mode for circulating refrigerant from the compressor means to the evaporator means to heat the ice mold means, the cabinet having air inlet means in one of the side walls for communicating the second compartment with a room in which the ice making machine is installed, condenser cooling fan means in the second compartment for drawing air through the air inlet means and through the condenser means into the second compartment, the cabinet having an air discharge opening communicating with the second compartment, vent pipe means connected to the air discharge opening for venting the second compartment outside of a room in which the ice making machine is installed, exhaust fan means in the vent pipe means for exhausting air from the second compartment through the vent pipe means, and circuit means for controlling operation of said compressor means and said condenser means and said exhaust fan means during an ice making cycle, the circuit means including means for turning the condenser cooling fan means on and off to control compressor discharge pressure, and means for operating said exhaust fan means when the compressor means is operating.

6. An ice making machine according to claim 5 wherein the air discharge opening is in the top wall and the vent pipe means extends upwardly from the cabinet means through a ceiling of a room in which the ice making machine is installed.

7. An ice making machine according to claim 6 wherein the circuit means includes electrical power conductors extending from the second compartment and inside the vent pipe means to the exhaust fan means.

8. An ice making machine according to claim 7 wherein said condenser cooling fan means is mounted for rotation about a generally horizontal axis.

9. An ice making machine according to claim 5 wherein the circuit means includes electrical power conductors extending from the second compartment and inside the vent pipe means to the exhaust fan means.

* * * * *